US006520165B1

(12) United States Patent
Steele

(10) Patent No.: US 6,520,165 B1
(45) Date of Patent: Feb. 18, 2003

(54) NOZZLE FOR EMITTING NITROUS OXIDE FOR FUEL TO ENGINES

(76) Inventor: Michael Wayne Steele, 10092 Riding Club La., Shreveport, LA (US) 71118

( * ) Notice: Subject to any disclaimer, the term of this patent is extended or adjusted under 35 U.S.C. 154(b) by 0 days.

(21) Appl. No.: 10/003,944

(22) Filed: Oct. 23, 2001

(51) Int. Cl.[7] ..... F02M 29/00
(52) U.S. Cl. ..... 123/590; 123/305; 123/531
(58) Field of Search ..... 123/531, 590, 123/1 A, 294–305

(56) References Cited

U.S. PATENT DOCUMENTS

| | | | | |
|---|---|---|---|---|
| 4,827,888 A | | 5/1989 | Vaznaian et al. | 123/531 |
| 5,699,776 A | | 12/1997 | Wood et al. | 123/531 |
| 5,743,241 A | | 4/1998 | Wood et al. | 123/531 |
| 5,839,418 A | | 11/1998 | Grant | 123/585 |
| 5,890,476 A | | 4/1999 | Grant | 123/585 |
| 6,116,225 A | * | 9/2000 | Thomas et al. | 123/590 |

* cited by examiner

*Primary Examiner*—Paul J. Hirsch
(74) *Attorney, Agent, or Firm*—Ronald M. Goldman

(57) ABSTRACT

A nozzle (7) for a nitrous oxide system for an internal combustion engine contains outlet (9), to produce a high velocity cylindrical stream of nitrous oxide (9') expressed in a certain direction (29) and another outlet (11), located on the same side of the nozzle, such as a slot, to produce a thin fan shaped mist of fuel (11') expressed in a second direction (31) from another location with the directions being inclined at an acute angle (α) relative to one another, preferably forty-five degrees. The spray of fuel and stream of nitrous oxide collide at a location (D1, 18) displaced from the side of the nozzle, wherein the high velocity stream of nitrous oxide further atomizes the fuel and mixes therewith as injected into the intake of the engine.

20 Claims, 2 Drawing Sheets

NOZZLE FOR EMITTING NITROUS OXIDE FOR FUEL TO ENGINES

FIELD OF THE INVENTION

This invention relates to nozzles for nitrous oxide systems for internal combustion engines, and, more particularly, to a nozzle design that promotes enhanced atomization of the fuel to boost combustion efficiency of the nitrous oxide and fuel mixture and increase the horsepower generated by the engine.

BACKGROUND

In a conventionally fueled internal combustion engine, vaporized fuel, typically either gasoline or alcohol, introduced through a carburetor mixes with outside air drawn into the engine manifold to form a combustible mix. That combustible mix, as example, is drawn from the intake manifold, through an intake runner of the manifold and into a cylinder of the engine. The combustible mix is ignited, typically, by an electric spark produced by a spark plug of the ignition system for the engine. The resultant explosion in the engine cylinder drives the piston, producing the mechanical force that is ultimately transferred to the wheels of the automobile. The foregoing combustion process repeats for each cylinder in the engine. The proportion of oxygen in a given volume of air relative to the other components of the air, such as nitrogen, is relatively fixed. Typically, through proper carburetion, the ratio of oxygen and fuel in the mixture, is set to the optimal ratio that is known to achieve the most efficient explosion.

To enhance performance of internal combustion engines in automotive racing application beyond that possible from conventional fuel systems, it has been known to inject nitrous oxide ("$N_2O$") into the cylinder along with the combustible mix introduced by the carburetor and to accompany the nitrous with an injection of additional fuel. The apparatus for doing so are known as nitrous oxide systems. The nitrous oxide system introduces nitrous oxide and fuel to accompany the mixture of fuel and external air from the carburetor to form a highly combustible mixture that is drawn into the engine manifold, and, thence, into the engine cylinders. When heated to elevated temperatures of 572 degrees F or so, available within the engine, the nitrous oxide decomposes into molecules of nitrogen and oxygen. In that way oxygen is added to that oxygen introduced through the carburetor, enriching the combustible mix in the cylinders.

The addition of only nitrous oxide to the combustible mix leans out the mix and would quickly result in overheating the engine resulting in engine damage. To avoid that heating, fuel is injected along with the nitrous to effectively enrich the mixture, maintaining a lower temperature in the engine cylinders. Typically, the amount of fuel added is significantly less than the volume of the added nitrous oxide, but the exact proportion remains the judgement of the drag racing enthusiast.

The combustible mixture produced is more powerful than before, and as a result the engine produces greater horsepower. Because the nitrous oxide contains proportionally much more oxygen molecules, when mixed with the added fuel, a more powerful explosion is produced on ignition. The nitrous oxide effectively enriches the combustible mixture. Compared to other techniques for increasing engine horsepower, the nitrous oxide technique accomplishes that increase at minimal expense.

Nitrous oxide is stored in a canister carried by the vehicle. The stored nitrous oxide is under high pressure that maintains the nitrous oxide in a liquid state. A plumbing system, including conduit and solenoid valves, extends from the storage canister to the engine intake manifold. That plumbing system and an associated plumbing system for the fuel are each coupled to a number of nozzles, each of which is associated with a respective cylinder of the multi-cylinder engine. Each nozzle contains separate passages for the nitrous oxide and the fuel. Through the nozzle, both the fuel and the nitrous oxide are introduced into the region of the intake manifold runners, where both are mixed together and drawn through the intake manifold, cylinder head, and into the cylinders.

Honed by competition, racing enthusiasts have sought to squeeze greater power from engines employing nitrous oxide systems. Most often the search for improvement is accomplished through. "hands-on" trial and error in the field and/or application a "sixth sense" of what to adjust or change, not by academia. Shaving a few fractions of a second from the time required to race a vehicle down a quarter-mile racetrack, though small in the absolute sense, is very significant to the enthusiast. Considerable time, effort and money is expended to achieve such improvements. As often said, no one remembers the person who placed second in a race.

One area of improvement has been the nozzle. One nozzle design in a nitrous oxide system is presented in U.S. Pat. No. 5,699,766 to Wood et al., granted Dec. 23, 1997, entitled Nozzle for Mixing Oxidizer With Fuel (hereafter the "'766 Wood patent"). In that design, the nitrous oxide stream under high pressure is expressed from a bowl shaped outlet at high velocity, changing state to a gas. From that outlet the nitrous oxide stream is directed into a mixing bowl region formed in the tip end of the nozzle adjacent the nitrous oxide outlet. A stream of fuel, pumped at conventional pressures, typically 5 psig, is expressed directly into the mixing bowl, where the fuel stream intersects, is impacted and atomized by and mixes with the stream of high pressure nitrous oxide gas. According to the Wood patent, the high velocity $N_2O$ stream creates a low pressure at the fuel outlet that assists to draw fuel from the fuel outlet. Nozzles constructed in accordance with the foregoing design have produced good results over the predecessor techniques and that nozzle achieved wide acceptance among racing enthusiasts.

Another nozzle design is presented in U.S. Pat. No. 5,890,476, granted Apr. 6, 1999 to Grant. The design provides for a wing-shaped nozzle body to aerodynamically modify movement of the airstream from the carburetor about the nozzle body. Further, in the Grant design, the nitrous oxide stream flows from a bell shaped outlet and passes by the front end of an adjacent U-shaped recess in and at the front end of the nozzle into which a stream of fuel is expressed from the conduit. The venting fuel stream is said to intersect the nitrous stream in front the bell shaped nitrous port. The foregoing nozzle design, like that of the '766 Wood patent, appears to rely upon the stream of nitrous oxide to both atomize the fuel and mix with that atomized fuel for entry into an intake manifold.

Although the foregoing nozzles of the foregoing Wood and Grant patents appear to provide appropriate atomization of the fuel and the mixing necessary to produce combustion, applicant has discovered that better atomization of fuel and intermixture of fuel and nitrous oxide is capable of extension beyond that which is possible from the foregoing nozzle designs.

Accordingly, a principal object of the present invention is to improve combustion in internal combustion engines that employ a nitrous oxide system.

A further object of the invention is to provide a nozzle design for a nitrous system that enhances atomization of the fuel and produce a more combustible mixture.

And a still further object of the invention is to provide a nitrous system nozzle that emits a jet or spray of finely divided liquid fuel into the nitrous oxide stream.

SUMMARY OF THE INVENTION

In accordance with the foregoing objects and advantages, the nitrous oxide system of the present invention includes a nitrous oxide emitting means for emitting a high velocity cylindrical stream of nitrous oxide from one location in a direction toward the intake manifold runner; and a fuel emitting means for emitting a thin fan shaped spray of atomized fuel from another location in another direction at an acute angle to the direction of the nitrous oxide stream. Both emitting means are oriented relative to one another so that the axes thereof form an acute angle there between and the stream of nitrous oxide and the thin fan shaped spray of fuel intersect at that acute angle at a location that is spaced from both emitting means in the direction of the intake manifold, wherein the high velocity stream of nitrous oxide impacts and further atomizes the fuel.

Further in accordance with the invention both emitting means comprise ports or outlets located on the same side of a nozzle. The nozzle contains a tip end for insertion inside the wall of the intake runner in the intake manifold of the internal combustion engine, and the fuel and nitrous oxide outlets are laterally spaced along and on the same side of the tip end, with the nitrous oxide outlet located closest to the distal or tip end of the nozzle.

Further in accordance with the invention, to produce the thin fan shaped mist or spray of atomized fuel, the fuel outlet is formed of a very thin slot. Fuel is pumped into the nozzle to that slot under a pressure within the range of five to eighty psig, with sixty psig being a preferred choice, recognizing that the higher the fuel pressure the better the atomization. In accordance with a more specific aspect to the invention, the acute angle between the nitrous oxide stream and the spray of fuel may be of a range of thirty-five to sixty degrees, with forty-five degrees being preferred.

The foregoing and additional objects and advantages of the invention, together with the structure characteristic thereof, which were only briefly summarized in the foregoing passages, will become more apparent to those skilled in the art upon reading the detailed description of a preferred embodiment of the invention, which follows in this specification, taken together with the illustrations thereof presented in the accompanying drawings.

DETAILED DESCRIPTION OF THE PREFERRED EMBODIMENTS

Figure 1:
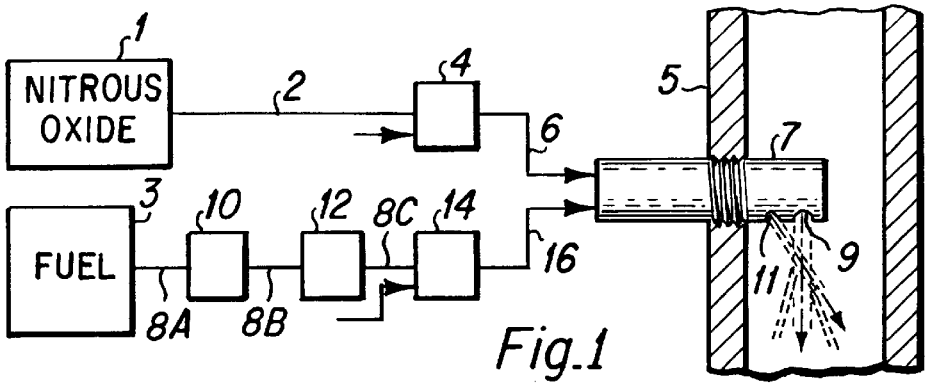
FIG. 1 illustrates a nitrous oxide fuel system for an internal combustion engine.

FIG. 1 to which reference is made pictorially illustrates the principal components of the nitrous oxide fuel system installed in the automobile. The system includes a pressurized tank or canister of nitrous oxide 1, a fuel tank with fuel 3, intake manifold runner 5 to the engine, and nozzle 7, the latter extending through a wall of the intake manifold and being supported by that wall. Although a dictionary definition of a nozzle appears to prescribe a single passage, inlet and outlet, in nitrous oxide systems the nozzle, typically, contains two passages, inlets and outlets, one each for the nitrous oxide and one for the fuel, later herein more fully illustrated and described. Accordingly, it should be understood that when reference is made herein to a nozzle, the reference is to one with separate passages for both fuel and nitrous oxide, unless the context prescribes otherwise. Canister 1 is connected by a fluid conduit 2 to a solenoid controlled fluid valve 4. The outlet of that fluid valve is connected by another fluid conduit 6, directly or indirectly, to the nitrous oxide inlet of nozzle 7.

Fuel from tank 3 is routed by fluid conduit 8A (eg. gas line) to fuel pump 10, thence by another section of fluid conduit 8B to a fuel pressure regulator 12, where the fuel pressure is set. From the fuel pressure regulator, the fuel, under pressure applied by the pressure regulator and fuel pump during operation, is routed via another section of fluid conduit 8C to solenoid controlled fuel valve 14. From the fuel valve, the fuel is routed via fluid conduit 16, directly or indirectly, to the fuel inlet of nozzle 7. The nitrous oxide and fuel outlets 9 and 11 are oriented facing in the direction of airflow or air/fuel intake charge that is being drawn into the manifold 5 from the carburetor, not illustrated, during engine operation. A scribe mark, not illustrated, on the exterior surface of the nozzle assists to ensure proper orientation of the nozzle on installation. Preferably, the nozzle screws into the manifold a sufficient distance to place the tip end of the nozzle at the center or axis of the intake runner 5 or the length of the front end of the nozzle is sufficient to so position the tip end.

The foregoing figure illustrates the nozzle and intake manifold relationship for a single one of the multiple engine cylinders found in an internal combustion engine. Fluid conduits 6 and 16 are respectively extended to like connected nozzles, not illustrated, associated with each of the remaining cylinders of the engine, not illustrated, of the internal combustion engine, which typically contain four, six or eight cylinders, so that each cylinder of the engine receives a nitrous fuel mixture. Typically, each cylinder, or more accurately, the intake manifold runners associated with respective engine cylinders receive the same amount of nitrous fuel mixture.

Typically the nitrous oxide in this embodiment is pressurized anywhere between 800 to 1100 psig with 1000 psig preferred, much the same as in prior nitrous oxide systems. The fuel pressure may be anywhere in the range of 5 to 80 psig, and, preferably, is 60 psig or higher using a high pressure fuel pump. The latter pressure is well above the fuel pressures of 5 to 10 psig normally used in conventional and in prior nitrous oxide systems.

As those skilled in the art appreciate, apart from the higher values of fuel pressure prefered and details of nozzle 7, the general relationship of the components and the plumbing shown in FIG. 1 is typical of the prior nitrous oxide systems. As is conventional, the solenoid controlled fluid valves 4 and 14, are controlled by the vehicle driver. By operating an electric switch in the vehicle, not illustrated, the driver is able to activate the solenoid valves, which open and allow the fuel and oxidizer to flow through the nozzle. With the nitrous oxide system operating, the engine achieves higher horsepower which accelerates the vehicle faster. The general operation of the present invention is thus seen as the same as in the prior nitrous oxide systems. The greatest difference provided by the present invention is in the nozzle, next considered.

Figure 2:
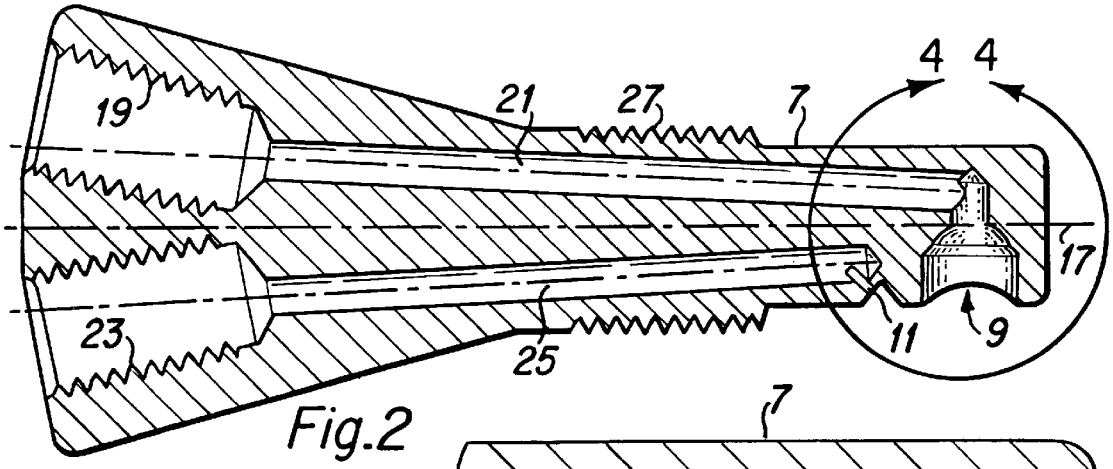
FIG. 2 is a side section view of an embodiment of the nozzle invention used in the system of FIG. 1.
Figure 3:
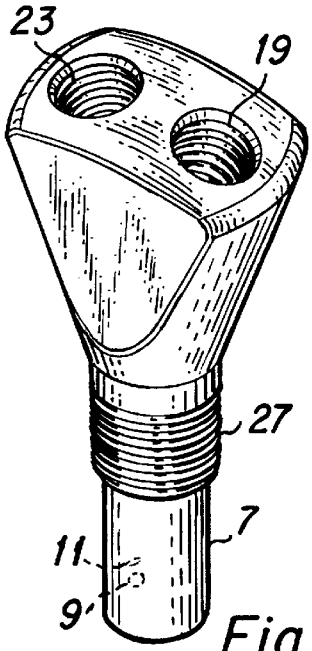
FIG. 3 is a perspective view of the nozzle of FIG. 2 drawn in a reduced scale

FIG. 2 shows a side section view of nozzle 7 and FIG. 3 is a perspective of nozzle 7 in a reduced scale as viewed from the rear. The nose or tip end of the nozzle is shown in enlarged section view in FIG. 4. FIG. 5 presents the tip end of the nozzle depicted in FIG. 4 in elevation view. The nozzle is formed of a single piece of metal, suitably aluminum, that is cut, shaped, milled and drilled to produce the various passages and outlets hereafter described. Other metals or materials that do not degrade in the engine environment may be substituted for aluminum.

FIG. 2 best illustrates the shape of the walls of the nitrous oxide outlet and the relative angular orientation of the fuel slot axis to the axis of the nitrous oxide outlet. Referring to FIGS. 2 and 3, nozzle 7 includes a threaded nitrous oxide inlet 19 that connects to an internal cylindrical conduit or passage. 21. The latter passage is inclined downwardly relative to the principal axis 17 of the nozzle, from left to right in the figure, and leads to nitrous oxide outlet 9, shown to the right adjacent the end of the nozzle. Nozzle 7 also contains a threaded fuel inlet 23 that connects to a second internal cylindrical conduit or passage 25, which may be of the same diameter as passage 25. The latter passage is upwardly inclined or tilted relative to principal axis inlet 17, from left to right in the figure, and leads to fuel outlet 11. The foregoing inlets are each threaded to receiving a mating conduit fitting to the respective nitrous oxide and fuel conduits or, as later herein described in connection with FIG. 8, receive a mating jet holder and jet orifices that are inserted in series with the respective fuel and nitrous oxide conduits.

A threaded shoulder 27 on the outer wall of the nozzle permits the nozzle to be screwed into a threaded opening in the intake manifold, as was illustrated in FIG. 1. Fuel outlet 11 and nitrous oxide outlet 9 are spaced a short distance from one another, longitudinally, along the principal axis 17 of nozzle 7. That relationship is illustrated in greater scale in the partial section view of FIG. 4 to which reference may be made. The nitrous oxide outlet 9 is located closest to the cylindrical distal or tip end of the nozzle, located at the right side of the figure. Both outlets 9 and 11 face outwardly from the cylindrical peripheral side of the nozzle and, as best viewed in FIG. 5, are centered in line at the same angular (circumferential) position about axis 17 of the nozzle.

Continuing with FIG. 5, fuel outlet 11 is a very thin slot, a rectangular passage that is substantially greater in width than height. As example, in practical embodiments the width to height ratio of the slot may be about 4.15 to 5.32. The width of the slot is oriented transverse to the axis 17 of the nozzle. The side ends of the slot are rounded. Slot 11 opens to the exterior of the nozzle from a position in quarter-moon shaped sidewall 13 formed in the side of nozzle 7. That sidewall is inclined to the nozzle axis 17. In this embodiment, that incline is at forty-five degrees, as better illustrated in FIG. 4.

Figure 4:
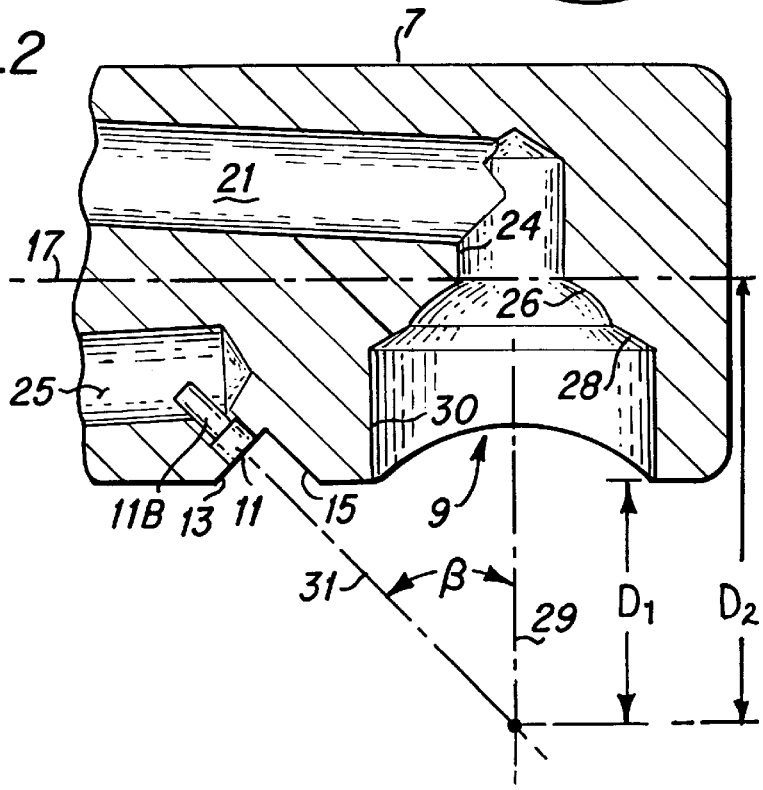
FIG. 4 is an enlarged partial side section view of the embodiment of FIG. 2.
Figure 5:
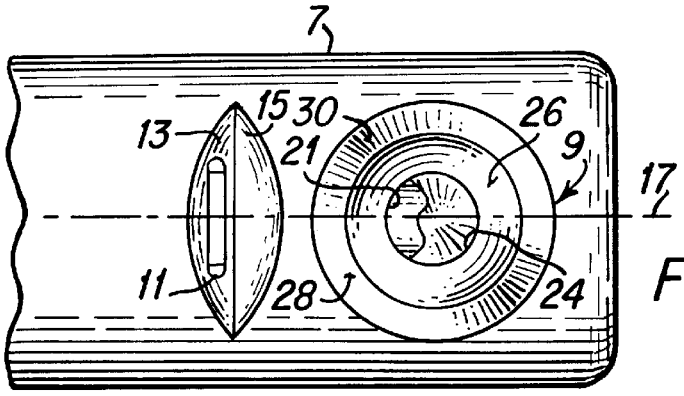
FIG. 5 is an partial front view of the nozzle of FIG. 2.

Continuing with FIG. 4, the passage through slot 11 is oriented perpendicular to sidewall 13 and extends into internal passage 25. The slot steps down in size toward the rear, and that portion of the slot is denoted as 11B, later herein more fully described. The axis 31 of slot 11 is inclined at an acute angle, $\alpha$, to axis 17 of the nozzle, and forms a forty-five degree angle, $\gamma$, to the axis 29 of nitrous oxide outlet 9. To physically accomplish the incline of the slot to the nozzle axis 17, it is necessary to cut into the cylindrical wall of the nozzle to form sidewalls 13 and 15 in the cylindrical nozzle wall.

Sidewalls 13 and 15, both quarter-moon-like in shape, are perpendicular to one another and in this side section of FIG. 4 defines a wide V-like profile. Those sidewalls are formed by moving a cutter that cuts to a short depth into the side of the nozzle in a line transverse the axis 17 of nozzle 7 at a location slightly in front the end of internal passage 25, the nozzle being sufficiently thick at that location to permit the cut. The depth of the cut is such as to result in a length and width to wall 13 that allows for the inclusion of slot 11 with slight clearance on the sides of the slot.

Figure 6:
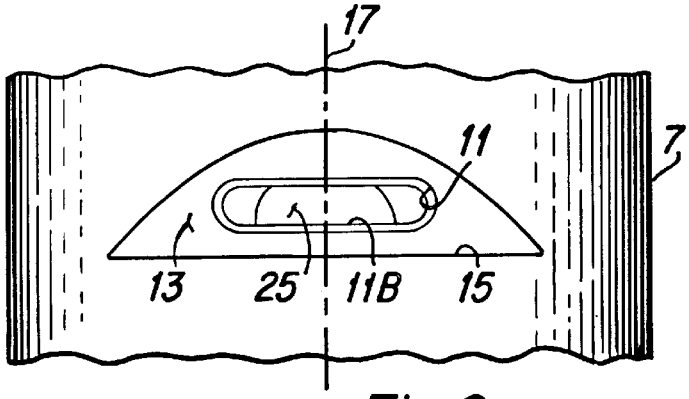
FIG. 6 shows the fuel slot of the nozzle portion shown in FIG. 5 in enlarged scale as viewed from a plane parallel to the slot.

The shape of slot 11 and wall 13 is more clearly viewed in an enlarged partial view of the relevant portion of nozzle 7 presented in FIG. 6 to which reference is made. In this figure, wall 13 is oriented so as to be perpendicular to the readers line of sight. Since wall 15 is perpendicular to wall 13, wall 15 appears in this view as a straight line. The passage defined by slot 11 to the connection with fuel passage 25 is stepped, as represented by the lip along the inner periphery formed by the inner wall section 11B to the slot. Slot 11 accesses passage 25 at a location from the side of the passage so that the connecting passage 11B between fuel passage 25 and the front of the slot is more narrow than the width of slot 11 at the front as seen in this view.

Figure 8:
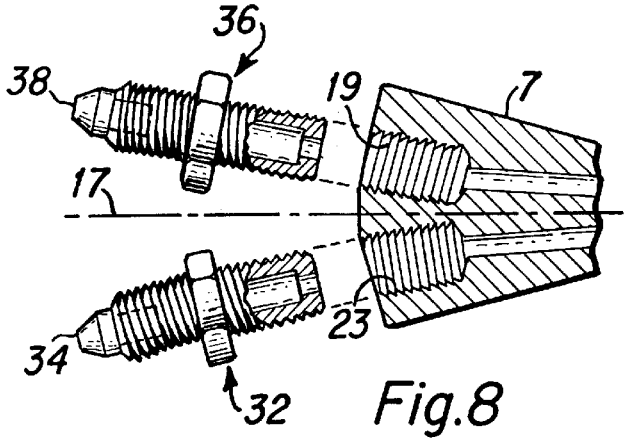
FIG. 8 shows the flow jet orifices that are used in the system of FIG. 1 to calibrate the amount of fuel and nitrous oxide feeding into the nozzle used in the system.

The cross section area of that connecting passage 11B to fuel passage 25 ideally is the same cross section area of the largest jet orifice, later discussed in connection with FIG. 8, as may be employed at the inlet 23 to passage 25. Having a cross section area for the exit that is equal to the size of the largest jet orifice that may be used in the system provides assurance that the highest possible pressure is obtained at the nozzle outlet. The foregoing design keeps fuel pressures higher at the nozzle outlet, which enhances atomization of the fuel, producing a finer mist of fuel on exit from the nozzle. The inner portion of the slot and wall portion 11B and the stepped construction is better viewed in FIG. 4 to which brief reference may again be made.

Reference is again made to the front view of FIG. 5. Nitrous oxide outlet 9 is in line with fuel outlet 11 along axis 17 of the nozzle and both outlets are centered at the same peripheral position along the surface of the nozzle, the same angular position about axis 17. The nitrous oxide outlet is circular in shape, defined by cylindrical wall 30, and is formed of sections of different diameter wall portions 24, 26, 28 and 30, later more fully described.

Referring again to the enlarged partial side section view of FIG. 4, nitrous oxide outlet 9 contains a central axis 29 that is oriented perpendicular to axis 17 of the nozzle. The axis 31 of fuel outlet 11 intersects central axis 29 of the nitrous oxide outlet and forms an angle of about 45 degrees there between (and, hence, 45 degrees to the axis 17 of the nozzle). The point of intersection between axes 29 and 31 is located at a position outwardly spaced a distance, $D_1$, away from the side of the nozzle (and a further distance $D_2$ away from nozzle axis 17) in the direction of the intake manifold and airstream flow, when installed. No straight line path exists from one outlet to the other within the confines of the nozzle body or along the outer surface of the nozzle body.

Nitrous oxide outlet 9 extends from the cylindrical shaped outer surface of nozzle 7 deep into the metal of the nozzle to a connection with the laterally extending cylindrical nitrous oxide passage 21. The nitrous oxide outlet is formed in the metal of the nozzle with wall sections having different geometrical shapes, from the front to the rear where the outlet connects to passage 21. Starting from the rear, the foregoing includes a cylindrical wall section 24 of small diameter, a spherical wall segment 26, a conical wall segment 28 and another cylindrical wall section 30, that is of larger diameter than cylindrical wall section 24. The cylindrical nitrous oxide passage 21 opens into the side of cylindrical section 24.

Geometrically, spherical wall 26 defines a segment, a slice of a sphere taken through a radius of the sphere. Conical walls 28 define a segment or slice of a right cone, taken parallel to the base of the cone. The conical segment forms a flare at the end of the spherical segment that leads into spherical segment 30. The diameter of cylindrical segment 30 matches the diameter of the terminal periphery of the flare so as to provide an unobstructed passage to oxidizer being expressed through the outlet. The front end of cylindrical segment 30 intersects with and conforms to the cylindrical outer surface of nozzle 7, producing the concave appearance of the front end of that cylindrical segment shown in FIG. 4. It is found that the foregoing outlet allows oxidizer under high pressure to be expressed from the outlet essentially as a forceful high velocity stream of a uniform cylindrical shape.

With the nozzle installed and the system assembled in a vehicle (as in FIG. 1, as example) and the solenoid controlled fuel and nitrous oxide valves open, the nitrous oxide and fuel are fed into the respective passages in the nozzles. Nitrous oxide is forced under pressure of about 1000 psig into and through nitrous oxide outlet 9. The nitrous oxide is expressed from the outlet as a powerful high velocity cylindrical stream directed along axis 29 or, as alternatively stated, a cylindrical beam-like stream of nitrous oxide. Released into the associated intake manifold runner, which is under lower pressure, the nitrous oxide changes from the liquid state to a gas, effectively expanding in volume. That expansion adds to the forcefulness of the expressed stream. Concurrently, fuel is pumped into the nozzle 7 under a pressure, as example, of sixty (60) psig and is expressed from fuel outlet 11 in the direction of axis 31 as a thin fan shaped spray of atomized particles. The nitrous oxide stream and fuel spray intersect and collide; the impact of the high velocity stream of nitrous oxide producing even greater atomization of the fuel, that is, producing fuel droplets that are more fine than before.

Figure 7:
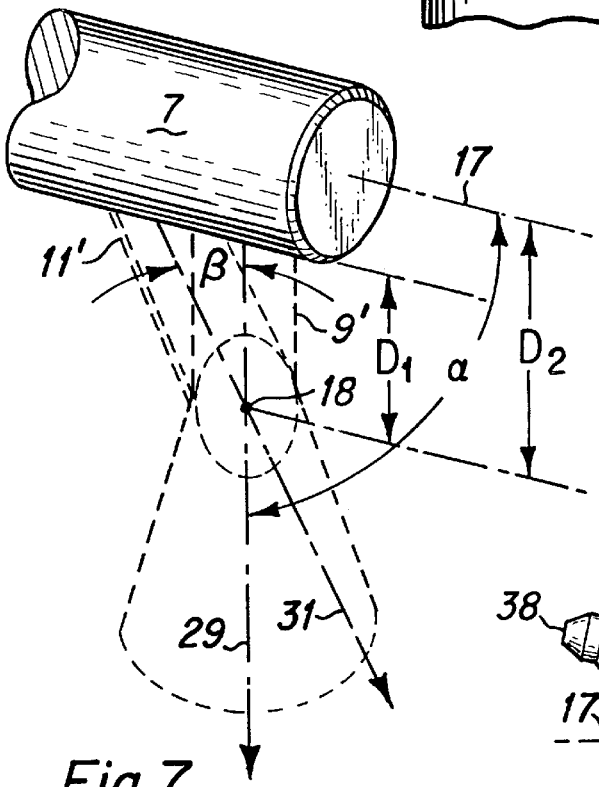
FIG. 7 is a pictorial view of the nozzle that illustrates the function of the nozzle.

FIG. 7 is a pictorial representation of the intersecting sprays. The atomized fuel emitted from the slot is represented by the outline of a thin fan shaped spray 11' and the cylindrical stream of nitrous oxide emitted from the adjacent outlet is represented by the outline 9', with both streams originating from the outlets on the underside of nozzle 7, not visible in this figure. The acute angle between those axes is represented as $\beta$ and the angle between the nozzle axis 17 and axis 29 is represented as $\alpha$. The intersection 18 of the respective axes 29 and 31 is the center of the location at which the cylindrical stream of nitrous "punches" into the fan shaped fuel spray to knock apart the atomized droplets of fuel in the spray into smaller size droplets and pushes the nitrous/fuel mixture toward the manifold intake.

The width of the fan shaped spray of fuel 11' at the location of collision with the cylindrical stream 9' is preferably the same as the diameter of stream 9' or no greater than that diameter so that all of the atomized fuel is further atomized by the nitrous stream. As those skilled in the art appreciate, if the spread of the fuel spray is wider than the diameter of the nitrous stream, some of the atomized fuel on the side edges of that spray will not be pounded by the nitrous stream, and, hence, the droplets of fuel won't be further atomized to finer droplet sizes by that stream. However, the invention will function as described, but not with the greatest possible efficiency.

With the new nozzle in the nitrous oxide system, the auto engine achieved greater performance than that obtained from the leading nozzle previously described in the background to this specification. Based on observation and intuitive skills acquired by years of "hands-on" experience in the sport, the belief is that the intersection of the powerful nitrous stream with the mist or spray of atomized fuel from the fuel slot produces additional atomization of the already atomized fuel. In other words, produces a greater number of smaller sized droplets of fuel and more thorough mixing. As is known, the finer the atomization of fuel in a combustible mix, the better the combustion obtained.

As an additional feature, the foregoing embodiment in application is preferably used in the nitrous oxide system with the familiar jets. The entrance 23 to the fuel inlet passage in the nozzle is threaded to receive a fitting that may connect directly to the fuel conduit. More typically, however, and as preferred for the present invention, a liquid flow restrictor or calibrator, referred to as a jet or jet orifice, 34, is installed in an associated jet holder 32, both illustrated in reduced scale in section in FIG. 8. The jet holder 32 is threaded into the fuel passage in nozzle 7, the jet orifice 34 is inserted into the holder placing the jet orifice in series fluid relationship in the fuel conduit to the nozzle, and a coupling slip nut coupled to the fuel line is threaded onto the holder and tightened to connect the fuel line to the jet holder and clamp the jet orifice in place. Another jet holder 36 and jet orifice 38 are included in the passage to nitrous oxide inlet 19 of the nozzle. Jet holders are attached to the nitrous and the fuel inlets of each nozzle in the nitrous oxide system for the engine and an appropriate jet orifice is selected and placed into each of those jet holders.

The jet orifice regulates the amount of fuel and nitrous oxide that is introduced, and, thereby, regulates the level of horsepower attained from the engine. The jets also regulates the nitrous oxide to fuel ratio of the mixture, which is critical to avoiding engine damage. Jets 34 and 38 are commercially available in a variety of hole diameters for use in nitrous oxide systems. Accordingly, the user can select different horsepower levels by changing the jets in the manner recommended by the manufacturer.

For the racing enthusiast, the size of the jet orifice is often equated with the horsepower levels one might obtain through simple change of jet orifice sizes. As example with a 0.033-inch diameter nitrous jet and the correct fuel jet, using eight such nozzles in a V-8 engine, one in each intake manifold runner, one can expect to obtain approximately 300 horsepower. With smaller size nitrous jets substituted, less horsepower will be obtained from that engine.

As one further appreciates, it is possible to use a fuel/nitrous conduit within the nozzle that contains an inner diameter that is the same as that of a selected jet and obtain the desired horsepower, and the nitrous oxide system will be is fully functional. However, that approach unduly limits one's flexibility. First, conduits are available in only a limited number of diameters, limiting one's flexibility.

Secondly, if one wished to change the volume of fuel/nitrous flow, one would have to replace the nozzle that contains the conduits. Replacing a small jet to make such a change is less expensive, simpler and easier. Accordingly, the preferred embodiment of the present invention should preferably be used in a nitrous system that incorporates jets.

As an additional feature to the invention, the fuel outlet slot 11 is sized to equal the area of the largest fuel jet orifice that one anticipates installing in the nitrous oxide system. In that way, one ensures that the fuel pressure and velocity at the outlet slot 11 is very close to the fuel pressure at the jet. That design and function aids in atomizing the fuel as the fuel exits from the slot, since it is the pressure level at the outlet orifice that counts in producing the desired atomization of fuel on expression from the slot, not the pressure at the orifice of the jet. The foregoing size relationship is a feature of the present invention which the prior nozzle system designs do not appear to address. As one appreciates, jets with smaller size orifices than the foregoing maximum size may be substituted and used with the nozzle. Even if a jet with a smaller size orifice is later substituted for the one with the larger orifice, the drop off in pressure at outlet slot 11 is not great enough to significantly impede the function of slot 11 or the operation of the invention.

When a fuel jet is installed to the inlet of the nozzles of the prior art nitrous oxide systems, the pressure at the fuel outlet of the nozzle is reduced from that level of pressure at the jet. As shown in the prior patent '766 patent to Wood, earlier cited, the fuel passage through the nozzle and the fuel outlet is of a particular diameter and opens to the exterior, the open space in the intake manifold runner, where the pressure is lower. The force acting to propel the fuel from the nozzle is reduced from that available at the jet in that system. As an example, if one inserts a jet with a 0.038 inch orifice in the fuel conduit in the nozzle system of the '766 Wood patent and set the fuel pressure to the recommended pressure level, the pressure drops to a lower level at a location in the nozzle behind the fuel outlet. The pressure drop occurs because the diameter of the fuel conduit formed inside the nozzle, leading to that fuel outlet is drilled to a diameter of 0.073 inches and defines a much larger area in cross-section than the area defined by the jet orifice. With reduced force, fuel droplets will be larger as the fuel is expressed from the fuel outlet of those prior nozzles, and the more one must rely upon the high pressure nitrous oxide stream to atomize the fuel.

Moreover, the nozzle of the '766 Wood patent makes use of the stream of expressed nitrous oxide to aid in expressing the fuel from the fuel outlet by creating a lower pressure at the fuel outlet that is due to the physical effect produced by a high velocity gas stream flowing past an orifice, such as the fuel outlet. Hence a higher pressure differential is intended to be produced between the fuel outlet and the pressure in the fluid passage in the nozzle. But the foregoing structure does not appear to be conducive to directly producing a spray of fuel.

According to a dictionary and as used herein, a stream is a body of flowing fluid; an unbroken flow; a spray is a jet of vapor or finely divided liquid; and a jet (of fluid) is a forceful stream of fluid discharged from a narrow opening or nozzle; and a mist is a fine spray. Based on the description of the prior patents and from observation of the operation of the prior art nozzle under simulated conditions, applicant concludes that the fuel expressed from the fuel outlet is not broken up into droplets. But if any droplets are formed as the fuel is emitted, even if unobserved by applicant, the droplets are likely of a large size, and that the force of the high velocity nitrous stream is principally responsible for producing such atomization of the fuel that is obtained in operation.

The present invention does not use or rely upon the stream of nitrous oxide to lower the pressure at the fuel outlet to assist in expressing the fuel. Nor does the present invention require a mixing bowl in the nozzle to permit the nitrous oxide stream to accomplish atomization of the fuel. The present invention obtains initial atomization of the fuel by emitting the fuel as a mist or spray. The fuel is atomized further into smaller droplets by the force of the high velocity nitrous oxide stream. That high velocity stream collides with and breaks apart and/or tears apart, shears, incident droplets of fuel into droplets of finer size, and further atomizes the fuel spray.

As is apparent, the fuel outlet of the prior nozzles apparently produce a relatively solid stream of fuel, much like the open end of a garden hose produces essentially a solid stream of water. That outlet does not alone produce minute size droplets of fuel and cannot produce atomized fuel. With a spray nozzle attached to the garden hose, the stream of water through the hose can be converted into a fine spray, essentially misting the water. In the present invention the slot-shaped fuel outlet appears to convert the fuel stream into such a spray, visibly producing minutely sized droplets of fuel. It is not possible to quantify the size and concentration of the droplets without high speed photography, currently unavailable to applicant, but the visible appearance in tests provides a qualitative basis for the occurrence of atomization.

When a liquid under high pressure is vaporized at an outlet, the vaporization produces a cooling effect, and would lower the temperature at the nitrous oxide outlet. Some believe that the refrigerating effect of vaporization is sufficient to form ice on the outlet from the moisture in the air taken into the intake manifold as would clog the nitrous oxide outlet, thereby ultimately changing the ratio of fuel to oxygen in the mixture to less than optimum, and, hence, lower the performance of the engine. Despite those fears, clogging of the nitrous oxide outlet was not experienced during research and development.

As earlier noted, the nitrous emitting outlet 9 at the tip end of nozzle 7 is preferably positioned in the center of the intake runner for best results. The length of that end of the nozzle, that is, referring again to FIG. 2, the distance from the end of shoulder 27 to the tip end at the right side of the figure, is necessarily determined by the cross section area and geometry of the intake runner of a particular internal combustion engine. The length of the emitting end of nozzle 7 is such as to properly position the nitrous emitter at the center of the intake runner. As recognized, different intake manifolds (and internal combustion engines) will require different lengths of the emitting portion of the nozzle. Thus the nozzle of the present invention.

In one practical embodiment slot 11 was 0.080 inches in width and 0.026 inches in height. The constricted inner passage 11B behind the slot was 0.067 inches wide by 0.019 inches height. And the slot was located approximately 0.369 inches from the distal end of the nozzle. Cylindrical passage 21 for the nitrous oxide was 0.067 inches diameter and cylindrical passage 25 for the fuel was 0.067 inches diameter. Axis 29 of nitrous oxide outlet 9 was located about 0.163 inches from the distal end of the nozzle. The cylindrical segment 30 of outlet 9 was 0.218 inches diameter and about 0.100 inches in height. The conical segment of that outlet was 0.218 inches diameter at the front end and 0.157 inches at the rear, providing a taper of about 59 degrees. Spherical segment 26 was a radius of 0.094 inches. Cylindrical segment 24 was 0.082 inches in diameter. The overall height of the outlet from the rear of 24, but not including the conical shaped extension defined by the profile of a drill bit, to the front wall of the outlet (and surface of the nozzle body) was 0.240 inches. The vertical distance between the side wall of nozzle 7 and the point of intersection 18 between axes 29 and 31, $D_2$, was 0.175 inches and the vertical distance between nozzle axis 17 and the point of intersection 18 between axes 29 and 31, $D_2$, was 0.330 inches.

In the preceding description, the spray of fuel issuing from slot 11 is referred to as a thin fan shaped spray, referring by analogy to a folding hand fan as an aid in description. As is known, such a fan is thin, and the reference to a fan shape implicitly already denotes thin, which makes the inclusion of that word in the description of the spray redundant. The added emphasis provided by including the word thin as a modifier is believed helpful to those few readers who may be unfamiliar with the appearance of the hand fan and for that reason should not be regarded as redundant.

It should also be appreciated that the reference to a fan shape is to be construed to subsume within the meaning of the term a ribbon shape. As one recognizes a slight shift in the spread of the fuel spray issuing from the slot, as might occur by lowering the fuel pressure in a practical embodiment, may narrow the spray somewhat, wherein the side edges of that spray may look parallel to some and appear as a ribbon. However, even with such an outlook the elements of the combination cooperate in the same way, achieve the same result described for the fan shaped spray and is equivalent. Further, as used herein the reference to spray concerning the fuel is understood to include a mist. And although the nitrous oxide stream may be alternately be referred to as a spray of nitrous oxide without departing from the invention, since the nitrous oxide released from the outlet is or becomes a gas, the connotation of the word stream appears better choice to describe the action that occurs, in operation.

It is believed that the foregoing description of the preferred embodiments of the invention is sufficient in detail to enable one skilled in the art to make and use the invention without undue experimentation. However, it is expressly understood that the detail of the elements comprising the embodiment presented for the foregoing purpose is not intended to limit the scope of the invention in any way, in as much as equivalents to those elements and other modifications thereof, all of which come within the scope of the invention, will become apparent to those skilled in the art upon reading this specification.

As example, the foregoing description recites that the axis 29 of the nitrous oxide stream intersects the axis 31 of the fuel spray. That relationship is preferred. That alignment is automatically configured when forming the openings in the nozzle with machine tools and is preferred since doing so ensures that the respective streams collide most efficiently. However, as those skilled in the art appreciate, it is not necessary for those axes to intersect, but it is necessary to have the two streams or sprays intersect and collide, and that collision can occur even if the respective axes do not intersect. Since the respective streams will still collide, though not symetrically, and perform as described with, perhaps only slightly less effective result, such an alternative embodiment is understood to come within the scope of the invention.

As further example and as becomes apparent from the description of the foregoing embodiment, it appears possible to practice the invention using separate nozzles of conventional structure (ie. one with a single passage, inlet and outlet) that together emulates nozzle 7 in function during operation. That is, one nozzle produces the cylindrical stream of nitrous oxide, the second nozzle produces the fan or ribbon shaped spray of fuel and the two nozzles are oriented relative to one another as attached to the manifold so that the nitrous oxide stream collides with the fuel spray. However, as one appreciates, the mechanical complexity, particularly in properly aligning the two streams and fabrication of separate structures, makes such an alternative appear extremely impractical and is definitely not preferred.

Thus, the invention is to be broadly construed within the full scope of the appended claims.

What is claimed is:

1. A nitrous oxide fuel system for an internal combustion engine, said internal combustion engine including an intake manifold, said intake manifold including an intake runner to provide a passage to the intake of said engine, comprising:

a nitrous oxide supply, including nitrous oxide, said nitrous oxide being in a fluid state and maintained under a high pressure;

a fuel supply, including fuel, said fuel being in a fluid state and maintained under a lower pressure than said nitrous oxide;

fuel emitting means for expressing and directing a fan shaped spray of fuel into said intake manifold in a direction toward said intake; and nitrous oxide emitting means for expressing and directing a stream of nitrous oxide at high velocity to intersect and collide with said spray of fuel at a location toward said intake spaced from both said emitting means, whereby said fuel in said spray is further atomized and mixed with said nitrous oxide.

2. The nitrous oxide fuel system as defined in claim 1, wherein said stream of nitrous oxide intersects said spray of fuel at an acute angle, said acute angle being an angle in the range of thirty-five degrees and sixty degrees.

3. The nitrous oxide fuel system as defined in claim 2, wherein said acute angle comprises forty-five degrees.

4. The nitrous oxide fuel system as defined in claim 1, wherein said fuel emitting means comprises a slot; and wherein said nitrous oxide emitting means comprises an outlet.

5. The nitrous oxide fuel system as defined in claim 4, wherein said outlet comprises a first cylindrical wall segment, a spheroidal wall segment, a conical wall segment, and a second cylindrical wall segment; said first cylindrical wall segment leading into said spheroidal wall segment, said spheroidal wall segment leading into said conical wall segment, said conical wall segment leading into said second cylindrical wall segment, and said second cylindrical wall segment opening toward said intake; said first cylindrical wall segment including a lateral opening in the cylindrical wall for coupling nitrous oxide from said nitrous oxide supply into said first cylindrical segment.

6. The nitrous oxide fuel system as defined in claim 1, wherein said stream of nitrous oxide comprises a cylindrical shape of predetermined diameter; and wherein said fan shaped spray of fuel spreads laterally of said first direction with distance from said fuel emitting means to define a beam spread at said intersection with said stream of nitrous oxide; said beam spread is no greater in width than said predetermined diameter.

7. The nitrous oxide fuel system as defined in claim 6, wherein said stream of nitrous oxide intersects said spray of fuel at an acute angle, said acute angle comprises forty-five degrees.

8. A nozzle for a nitrous oxide system for an internal combustion engine comprising:

an outlet for expressing a high velocity cylindrical stream of nitrous oxide inside the intake runner of the intake manifold of an internal combustion engine;

a thin slot for expressing a fan shaped mist of fuel at an acute angle toward said high velocity stream of nitrous oxide, wherein said high velocity stream of nitrous oxide intersects and collides with said fan shaped mist of fuel to further produce a finer mist of fuel mixed with nitrous oxide.

9. A nozzle for delivering nitrous oxide and fuel into the intake runner of the intake manifold of an internal combustion engine, comprising:

an elongate metal body having first and second ends;

attaching means for attaching said elongate metal body to the wall of an intake runner with said second end and a portion of said elongate body positioned inside said intake runner and said first end and said remaining portion of said elongate body being positioned exterior of said intake runner;

first and second passages inside said elongate body, said passages extending from respective inlets at said first end and longitudinally extending through a substantial portion of the length of said elongate body toward and terminating short of said second end;

said first passage for receiving fuel from an external source, said fuel being in a liquid state; and said second passage for receiving nitrous oxide from an external source, said nitrous oxide being in a liquid state;

a fuel outlet port and a nitrous oxide outlet port located on the same side of said elongate body;

said fuel outlet port for emitting a spray of fuel in one direction exterior of said metal body, said spray of fuel comprising particles of fuel; and said nitrous oxide outlet port for emitting a high velocity stream of nitrous oxide in another direction exterior of said metal body to collide with said spray of fuel, wherein said particles of fuel are broken into finer particles.

10. A nozzle for supplying nitrous oxide and fuel within an intake runner of the intake manifold of an internal combustion engine, comprising:

an elongate metal body including a side, a body axis and first and second ends;

attachment means for attaching said elongate metal body to the wall of an intake runner with said second end and a portion of said elongate metal body positioned inside said intake runner and said first end and said remaining portion of said elongate metal body being positioned exterior of said intake runner;

first and second passages in said elongate metal body, said passages extending from respective inlets at said first end and longitudinally extending through a substantial portion of the length of said elongate metal body toward d and terminating short of said second end thereof;

said first passage for receiving fuel from an external source, said fuel being in a liquid state and said second passage for receiving nitrous oxide from an external source, said nitrous oxide being in a liquid state;

a fuel outlet port and a nitrous oxide outlet port located at longitudinally spaced locations in said side of said metal body;

said fuel outlet port having a port axis and said nitrous oxide outlet port having another port axis;

said fuel outlet port being connected to said first passage for receiving said fuel and for emitting a spray of fuel in a first direction exterior of said metal body; and said nitrous oxide outlet port being connected to said second passage for admitting said nitrous oxide and for emitting a high velocity stream of nitrous oxide in a second direction exterior of said elongate metal body;

said first direction and said second direction defining an acute angle therebetween, wherein said high velocity stream of nitrous oxide intersects and collides with said spray of fuel along a second direction and into collision with said expressed fuel at a position spaced from the side of said elongate metal body.

11. The nozzle for supplying nitrous oxide and fuel within an intake runner of the intake manifold of an internal combustion engine as defined in claim 10, wherein said spray of fuel comprises a thin fan shape; and wherein said stream of nitrous oxide comprises a cylindrical shape.

12. The nozzle for supplying nitrous oxide and fuel within an intake runner of the intake manifold of an internal combustion engine as defined in claim 10, wherein said acute angle is in the range of thirty five degrees and sixty degrees.

13. The nozzle for supplying nitrous oxide and fuel within an intake runner of the intake manifold of an internal combustion engine as defined in claim 12, wherein said acute angle comprises forty-five degrees.

14. The nozzle for supplying nitrous oxide and fuel within an intake runner of the intake manifold of an internal combustion engine as defined in claim 10, wherein said fuel outlet port comprises a thin slot, said thin slot being oriented transverse to said body axis.

15. The nozzle for supplying nitrous oxide and fuel within an intake runner of the intake manifold of an internal combustion engine as defined in claim 14, wherein said nitrous oxide outlet port comprises a cylindrical opening.

16. The nozzle for supplying nitrous oxide and fuel within an intake runner of the intake manifold of an internal combustion engine as defined in claim 14, wherein said nitrous oxide outlet port comprises:

a first cylindrical wall segment; a spheroidal wall segment; a conical wall segment; and a second cylindrical wall segment;

said first cylindrical wall segment leading into said spheroidal wall segment, said spheroidal wall segment leading into said conical wall segment, said conical wall segment leading into said second cylindrical wall segment, and said second cylindrical wall segment opening to the exterior of said elongate metal body;

said first cylindrical wall segment including a lateral opening there through; and said lateral opening providing a passage into said second passage for admitting nitrous oxide into said first cylindrical segment.

17. The nozzle for supplying nitrous oxide and fuel within an intake runner of the intake manifold of an internal combustion engine as defined in claim 10, wherein said nitrous oxide outlet port is located more close to said second end of said elongate metal body than said fuel outlet port.

18. The nozzle for supplying nitrous oxide and fuel within an intake runner of the intake manifold of an internal combustion engine as defined in claim 11, wherein said fan shaped spray of fuel spreads laterally of said first direction with distance from said fuel outlet port to define a beam spread at said intersection with said stream of nitrous oxide;

wherein said cylindrical stream of nitrous oxide comprises a predetermined diameter at said intersection with said fan shaped spray of fuel;

said beam spread of said fan shaped spray of fuel at said intersection with said cylindrical stream of nitrous oxide is no greater in width than said predetermined diameter.

19. The nozzle for supplying nitrous oxide and fuel within an intake runner of the intake manifold of an internal combustion engine as defined in claim 14, wherein said thin slot comprises a stepped slot, said stepped slot including a first and a second portion arranged in serial order between said first passage and said side; said second portion being open to said side of said elongate metal body and said first portion being open to said first passage; said second portion being thin and said first portion being more thin than said first portion.

20. A nozzle for supplying nitrous oxide and fuel within an intake runner of the intake manifold of an internal combustion engine, said intake runner leading to the intake of said internal combustion engine, comprising:

an elongate metal body including a side, a body axis and first and second ends;

threaded attachment means for attaching said elongate metal body to the wall of an intake runner with said second end and a portion of said elongate metal body positioned inside said intake runner and said first end and said remaining portion of said elongate metal body being positioned exterior of said intake runner;

first and second passages in said elongate metal body, said passages extending from respective inlets at said first end and longitudinally extending through a substantial portion of the length of said elongate metal body toward and terminating short of said second end thereof;

said first passage for receiving fuel from an external source, said fuel being in a liquid state and under a first predetermined pressure and said second passage for receiving nitrous oxide from an external source, said nitrous oxide being in a liquid state and being under a second predetermined pressure, substantially greater than said first predetermined pressure;

a fuel outlet comprising a thin slot, said slot being oriented transverse said body axis and said slot having a slot axis;

a nitrous oxide outlet, comprising:

a first cylindrical wall segment; a spheroidal wall segment; a conical wall segment; and a second cylindrical wall segment;

said first cylindrical wall segment leading into said spheroidal wall segment, said spheroidal wall segment leading into said conical wall segment, said conical wall segment leading into said second cylindrical wall segment, and said cylindrical wall segment opening to the exterior of said first means; and said first cylindrical wall segment including a lateral opening there through;

said lateral opening providing a passage into said second passage for admitting nitrous oxide into said first cylindrical segment;

said nitrous oxide outlet including an axis;

said fuel outlet and said nitrous oxide outlet being longitudinally spaced along said body axis and located in line on said side of said elongate metal body, and said nitrous oxide outlet being more close to said second end than said fuel outlet;

said fuel outlet being connected to said first passage for receiving said fuel and for emitting a fan shaped spray of fuel exterior of said metal body in a direction along said axis of said fuel outlet;

said nitrous oxide outlet port being connected to said second passage for receiving said nitrous oxide and for emitting a high velocity cylindrical stream of nitrous oxide exterior of said elongate metal body and along said axis of said nitrous oxide outlet;

said axis of said nitrous oxide outlet being oriented at ninety degrees from said body axis;

said axis of said nitrous oxide outlet intersecting said axis of said fuel outlet at an angle of approximately forty-five degrees to define a point of intersection spaced from each of said outlets and from said side of said elongate metal body, wherein said high velocity cylindrical stream of nitrous oxide intersects and collides with said spray of fuel to more finely divide the finely divided liquid of said spray and mix therewith;

said fan shaped spray of fuel spreading laterally of said axis of said fuel outlet with distance from said fuel outlet to define a beam spread at said intersection of said axis of said fuel outlet and said axis of said nitrous oxide outlet;

said high velocity cylindrical stream of nitrous oxide comprising a predetermined diameter at said intersection of said axis of said fuel and nitrous oxide outlets; and said beam spread of said fan shaped spray of fuel at said intersection with said cylindrical stream of nitrous oxide being approximately equal to said said predetermined diameter.

* * * * *

UNITED STATES PATENT AND TRADEMARK OFFICE

CERTIFICATE OF CORRECTION

PATENT NO. : 6,520,165 B1
DATED : February 18, 2003
INVENTOR(S) : Michael Wayne Steele It is certified that error appears in the above-identified patent and that said Letters Patent is hereby corrected as shown below:

Title page, Item [54] and Column 1, lines 1 and 2,
The title should read -- NOZZLE FOR EMITTING NITROUS OXIDE AND FUEL TO ENGINES --.

Column 13,
Line 62, delete "d".

Signed and Sealed this

Twenty-second Day of July, 2003

JAMES E. ROGAN
*Director of the United States Patent and Trademark Office*